US010850521B2

(12) United States Patent
Kammerzell et al.

(10) Patent No.: US 10,850,521 B2
(45) Date of Patent: Dec. 1, 2020

(54) INK STORAGE UNIT HAVING VARIABLE VOLUME RESERVOIRS

(71) Applicant: HEWLETT-PACKARD DEVELOPMENT COMPANY, L.P., Spring, TX (US)

(72) Inventors: Barret Kammerzell, Barcelona (ES); Marta Coma Vives, Barcelona (ES); Daniel Callejo, Sant Cugat del Valles (ES); Guillem Montero Costa, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/765,810

(22) PCT Filed: Oct. 29, 2015

(86) PCT No.: PCT/EP2015/075107
§ 371 (c)(1),
(2) Date: Apr. 4, 2018

(87) PCT Pub. No.: WO2017/071756
PCT Pub. Date: May 4, 2017

(65) Prior Publication Data

US 2018/0290454 A1 Oct. 11, 2018

(51) Int. Cl.
*B41J 2/175* (2006.01)

(52) U.S. Cl.
CPC ..... *B41J 2/17513* (2013.01); *B41J 2/175* (2013.01); *B41J 2/17523* (2013.01); *B41J 2/17533* (2013.01); *B41J 2002/17516* (2013.01)

(58) Field of Classification Search
CPC ..... B41J 2/17513; B41J 2/17533; B41J 2/17523; B41J 2/175; B41J 2002/17516
See application file for complete search history.

(56) References Cited

U.S. PATENT DOCUMENTS 4,695,824 A 9/1987 Tazaki
5,189,438 A 2/1993 Hine
5,975,686 A 11/1999 Hauck et al.
(Continued)

FOREIGN PATENT DOCUMENTS

CN 101503029 8/2009
CN 101670710 3/2010
(Continued)

OTHER PUBLICATIONS

Riegger, L. et al.; "A Dispensing System for Sedimenting Metal Microparticle Solutions Based on a Circulation Mixer Method"; Oct. 8-10, 2014; http://www.imtek.de/data/lehrstuehle/app/dokumente/conferences-pdf/conferences%202014/riegger-a-dispensing-system.
(Continued)

*Primary Examiner* — Sharon A. Polk
(74) *Attorney, Agent, or Firm* — Fabian Vancott

(57) ABSTRACT

Herein is disclosed an ink storage unit. The ink storage unit may comprise first and second reservoirs, each having a variable internal volume; a transfer system to transfer ink between the first and second reservoirs such that as ink is transferred from the first reservoir to the second reservoir, the internal volume of the first reservoir decreases and the internal volume of the second reservoir increases.

19 Claims, 9 Drawing Sheets

(56) References Cited

U.S. PATENT DOCUMENTS

| | | | | |
|---|---|---|---|---|
| 8,444,259 | B2 | 5/2013 | Bennett | |
| 2010/0060701 | A1 | 3/2010 | Takada et al. | |
| 2010/0079562 | A1 | 4/2010 | Katada et al. | |
| 2012/0075390 | A1* | 3/2012 | Park | B41J 2/175 347/85 |
| 2015/0085028 | A1* | 3/2015 | Takahashi | B41J 2/1752 347/86 |
| 2015/0097881 | A1* | 4/2015 | Kimura | B41J 2/17596 347/6 |
| 2016/0368274 | A1* | 12/2016 | Ohtsu | B41J 2/175 |
| 2017/0326881 | A1* | 11/2017 | Lebron | B41J 2/18 |

FOREIGN PATENT DOCUMENTS

| | | |
|---|---|---|
| CN | 103241000 | 8/2013 |
| EP | 2088001 | 8/2009 |
| EP | 2093065 | 8/2009 |
| FR | 2876948 | 4/2006 |
| WO | WO-2006078931 | 7/2006 |
| WO | WO-2007047044 | 4/2007 |
| WO | WO-2008067202 | 6/2008 |
| WO | WO-2015047306 | 4/2015 |

OTHER PUBLICATIONS

Zhao, "Flexographic Printing Technology", China Light Industry Press, Apr. 1, 2003, pp. 75-79.

* cited by examiner

INK STORAGE UNIT HAVING VARIABLE VOLUME RESERVOIRS

BACKGROUND

Some ink compositions, e.g. ink-jet compositions, contain particulates, e.g. inorganic particulates dispersed in a liquid carrier. Inkjet printing is a printing method that utilizes electronic signals to control and direct droplets or a stream of ink to be deposited on media. Some commercial and industrial inkjet printers utilize fixed print heads and a moving substrate web in order to achieve high speed printing. Ink may reside in a printer in a storage unit, e.g. a cartridge, which may be replaced once depleted.

DETAILED DESCRIPTION

Figure 1:
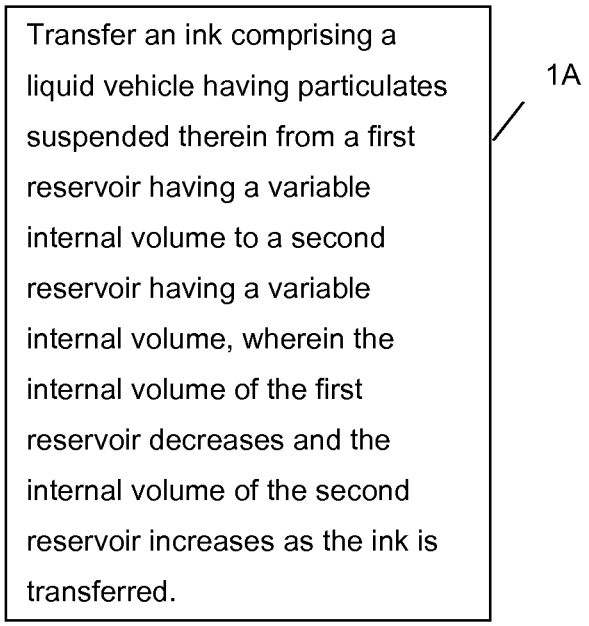
FIGS. 1-4 each illustrates an example of a method as described herein.

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Similar or equal elements in the Figures may be indicated using the same numeral.

Before the apparatus, methods and related aspects are disclosed and described, it is to be understood that this disclosure is not limited to the particular process steps and materials disclosed herein because such process steps and materials may vary somewhat. It is also to be understood that the terminology used herein is used for the purpose of describing particular examples.

It is noted that, as used in this specification and the appended claims, the singular forms "a," "an," and "the" include plural referents unless the context clearly dictates otherwise.

As used herein, "liquid vehicle," "vehicle," or "liquid medium" refers to the fluid in which the colorant of the present disclosure can be dispersed or dissolved to form an ink, e.g. an inkjet ink. Liquid vehicles are known in the art, and a wide variety of ink vehicles may be used in accordance with examples of the present disclosure. Such ink vehicles may include a mixture of a variety of different agents, including without limitation, surfactants, organic solvents and co-solvents, buffers, biocides, viscosity-modifiers, sequestering agents, stabilizing agents, anti-kogation agents, and water. Though not part of the liquid vehicle per se, in addition to the colorants, the liquid vehicle can carry solid additives such as polymers, latexes, UV curable materials, plasticizers, salts, etc. Additionally, the term "aqueous liquid vehicle" or "aqueous vehicle" refers to a liquid vehicle including water as a solvent.

As used herein, "particulates" refers to solid material in particulate form, which may comprise a pigment.

As used herein, "pigment" generally includes pigment colorants, magnetic particles, metallic particles, metal oxides such as aluminas, silicas, titanias, and/or other ceramics, organo-metallics or other opaque particles, whether or not such particulates impart color. Thus, though the present description primarily exemplifies the use of pigment colorants, the term "pigment" can be used more generally to describe not only pigment colorants, but other pigments such as organometallics, ferrites, ceramics, etc. In some examples, however, the pigment is a pigment colorant.

As used herein, the term "about" is used to provide flexibility to a numerical range endpoint by providing that a given value may be a little above or a little below the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or subranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1 to 3, from 2 to 4, and from 3 to 5, etc. This same principle applies to ranges reciting only one numerical value. Furthermore, such an interpretation should apply regardless of the breadth of the range or the characteristics being described.

Herein is disclosed an example ink storage unit. The ink storage unit may comprise:

first and second reservoirs, each having a variable internal volume, and a transfer system to transfer ink between the first and second reservoirs such that as ink is transferred from the first reservoir to the second reservoir, the internal volume of the first reservoir decreases and the internal volume of the second reservoir increases. An example of an ink storage unit and its use is described below in relation to FIG. 5 below.

Figure 2:
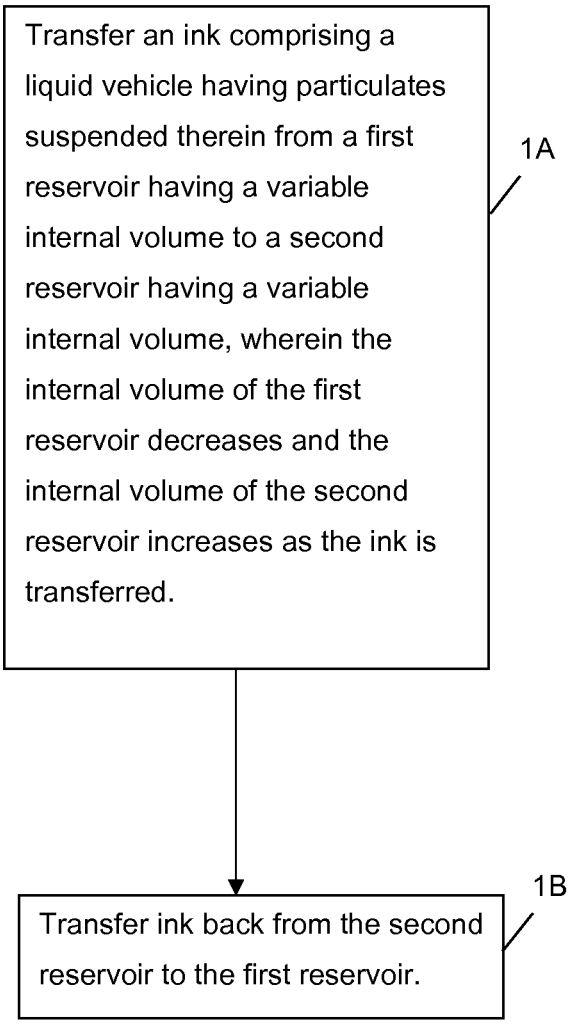
Figure 3:
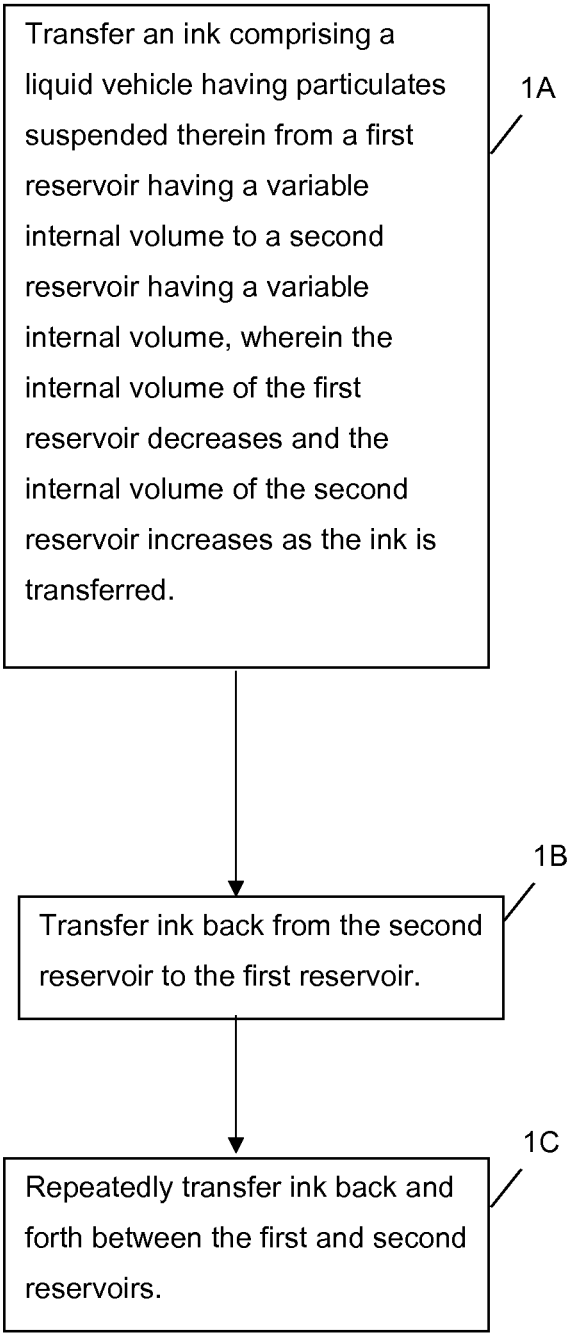
Figure 4:
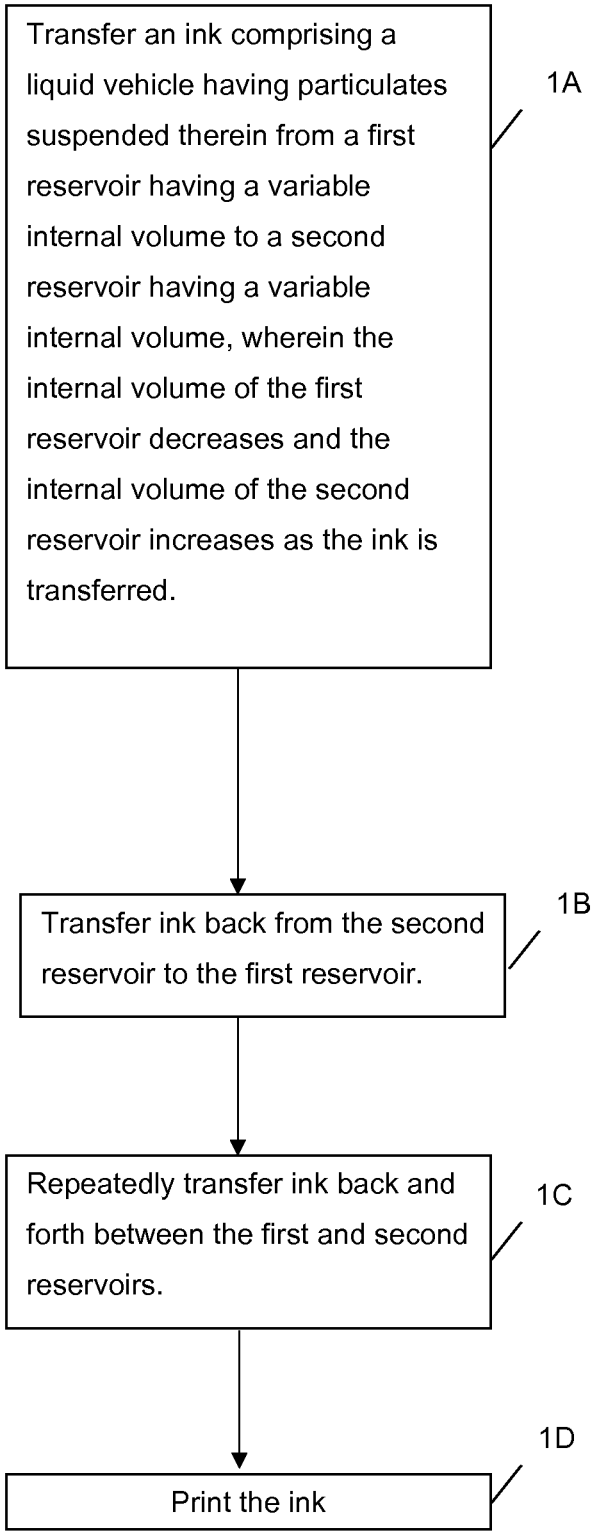

Herein is disclosed an example method. As illustrated in FIG. 1, the method may comprise: (1A) transferring an ink comprising a liquid vehicle having particulates suspended therein from a first reservoir having a variable internal volume to a second reservoir having a variable internal volume, wherein the internal volume of the first reservoir decreases and the internal volume of the second reservoir increases as the ink is transferred. As illustrated in FIG. 2, the method may further comprise (1B) transferring ink back from the second reservoir to the first reservoir. As illustrated in FIG. 3, the method may further comprise (1C) repeatedly transferring ink back and forth between the first and second reservoirs. As illustrated in FIG. 4, the method may further comprise (1D) printing the ink.

Herein is disclosed an example printer for printing ink. The printer may comprise:

a print head and an ink storage unit comprising:

- first and second reservoirs, each having a variable internal volume
- a transfer system to transfer ink between the variable-volume reservoirs such that, as ink is transferred from the first reservoir to the second reservoir, the internal volume of the first reservoir decreases and the internal volume of the second reservoir increases. The print head may be fluidly connected to the ink storage unit, to allow transfer of ink from the ink storage unit to the print head Some ink compositions containing particulates have a tendency to settle over time. This tendency is particularly pronounced in inks containing inorganic particulates such as titanium dioxide. Various techniques have been employed to try to minimise the settlement over time. Examples of the ink storage unit, method and printer described herein allow an ink to be stored over a period of time with limited settlement of particles and with reasonable energy efficiency.

Reservoirs

The first and second reservoirs may each have a variable internal volume, i.e., such that their internal volume, i.e., capacity for holding ink, can be increased and decreased. The first and second reservoirs may be termed first and second variable-volume reservoirs, respectively, for brevity. The variable volume reservoirs are fluidly connected to one another to allow the transfer of ink from one reservoir to another. In some examples, the ink storage unit comprises first and second variable volume reservoirs, the reservoirs being fluidly connected to one another, the transfer system allowing ink to be transferred from the first variable-volume reservoirs to the second variable-volume reservoir and back again. The transfer system may comprise a pump fluidly connected to each of the variable volume reservoirs to allow fluid to be pumped between the reservoirs, i.e., both to each reservoir and from each reservoir.

In some examples, the first and/or second variable volume reservoirs may each be or comprise a bag having walls comprising a flexible material. The bag may be such that the internal volume increases as ink is transferred, e.g., pumped, into it and decreases as ink is transferred, e.g., pumped, out of it. The flexible material may comprise a plastic film. The plastic film may comprise a plurality of layers. In some examples, the plastic film comprises a polyalkylene layer (e.g. polyethylene or polypropylene) and, in some examples, at least one further layer comprising a polar barrier material. The polar barrier material may comprise a material selected from ethylene-vinyl alcohol copolymer (EVOH), propylene-vinyl alcohol copolymer (PVOH), polyvinylidene chloride (PVDC), polyamides, nylons, nitrile copolymers, polyacrylonitriles (PAN), and polyethylene terephthalate (PET). The walls of the variable volume reservoirs, e.g., the plastic film, may have a thickness of 1 mm or less, in some cxampkcs examples 0.5 mm or less, in some examples 0.2 mm or less, in some examples 0.1 mm or less, in some examples 75 μm or less. The walls of the variable volume reservoirs, e.g. the plastic film, may have a thickness of at least 10 μm, in some examples at least 20 μm, in some examples at least 30 μm, in some examples at least 40 μm, in some examples at least 50 μm, in some examples at least 75 μm. The walls of the variable volume reservoirs, e.g. the plastic film, may have a thickness of from 10 μm to 1 mm, in some examples, a thickness of from 50 μm to 0.2 mm, in some examples from 70 μm to 160 μm.

Each variable volume reservoir may have a port that will act as the inlet and/or outlet for the ink as it is transferred into/out of the variable volume reservoir. In some examples, each variable volume reservoir is a bag having walls comprising a flexible material, and having a single port therein for transfer of ink into and out of the bag.

In some examples, the first and/or second variable volume reservoirs may comprise rigid walls, least one of which moves relative to the other walls to effect a change of internal volume in the reservoir.

At least one further variable-volume reservoir may be provided in fluid communication with first and/or second variable volume reservoirs, and there may be provided a transfer system to transfer ink from the first and/or second variable-volume reservoirs to the at least one further variable volume reservoir.

Transfer System

There may be provided a transfer system to transfer ink between the variable-volume reservoirs such that as ink is transferred from the first reservoir to the second reservoir, the internal volume of the first reservoir decreases and the internal volume of the second reservoir increases. The transfer system may transfer ink back and forth between the variable-volume reservoirs such that as ink is transferred from the first reservoir to the second reservoir, the internal volume of the first reservoir decreases and the internal volume of the second reservoir increases, and then as ink is transferred back from the second reservoir to the first reservoir, the internal volume of the second reservoir decreases and the internal volume of the first reservoir increases.

In some examples, the transfer system may comprise a pump for pumping ink from one reservoir to another. The pump may be fluidly connected to each of the first and second reservoirs and be a bi-directional pump, allowing fluid flow in both directions through the pump. In some examples, the transfer system comprises two single-directional pumps, one for pumping ink from the first reservoir to the second reservoir, and the other for pumping ink from the second reservoir to the first reservoir. The pump may be any suitable type. In some examples, the pump is a positive displacement pump. In some examples, the pump is selected from a diaphragm pump, a gear pump, a screw pump, a progressing cavity pump a roots-type pump, a peristaltic pump, a plunger pump, a triplex-style plunger pump and a rope pump. A diaphragm pump may be effective when ink containing high amounts of particulates is used. A diaphragm pump is a type of pump having a portion with a movable diaphragm, either side of which are valves, which cause fluid flow through the pump in a particular direction as the diaphragm is moved. In some examples, the transfer system may comprise a compression unit to compress the first and/or second reservoir to effect a decrease in the internal reservoir of the first or second reservoir, effecting transfer to the other reservoir.

In some examples, the first variable-volume reservoir contains ink and the transfer of ink from the first reservoir to the second reservoir transfers at least 50% of the volume of ink from the first reservoir to the second reservoir, in some examples at least 60%, in some examples at least 70%, in some examples at least 80%, in some examples at least 90%, in some examples at least 95%, in some examples at least 98%, of the volume of the ink from the first reservoir to the second reservoir; and in some examples the volume of ink transferred from the first reservoir to the second reservoir is transferred back from the second reservoir to the first reservoir.

In some examples, ink may be transferred in a plurality of cycles from first to second variable volume reservoirs and back again. Each cycle may have a transfer time period, in which ink is transferred from one reservoir to another and, in some examples, a rest time period, in which no ink is being transferred from one reservoir to another. The transfer time period may be any suitable time period. In some examples, the transfer time period may be at least 1 minute, in some examples at least 5 minutes, in some examples at least 15 minutes, in some examples at least 20 minutes. In some examples, the transfer period is shorter than the rest period. In some examples, the transfer period is longer than the rest period. In some examples, the rest period is at least 10 minutes, in some examples at least 15 minutes, in some examples at 30 minutes, in some examples at least 45 minutes, in some examples at least 1 hour, in some examples at least 2 hours, in some examples at least 3 hours, in some examples at least 3.5 hours. In some examples, the rest period may be from 2 hours to 6 hours, in some examples, from 3 hours to 5 hours, in some examples 3.5 hours to 4.5 hours, in some examples about 4 hours. The ratio between the transfer period and the rest period may be 1:50 to 50:1, in some examples 1:40 to 40:1, in some examples 1:30 to 30:1, in some examples 1:50 to 1:1, in some examples 1:40 to 1:2, in some examples 1:40 to 1:10; in some examples 1:30 to 1:10, in some examples 1:15 to 1:5.

The variable volume reservoirs and the transfer system may be contained within a housing. The housing may, for example, comprise a plastic or cardboard receptacle.

The ink storage unit may further comprise a conduit, e.g. a pipe, to allow fluid attachment to suitable components of a printer to allow ink to be transferred from the ink storage unit to the print head of a printer. The conduit may be in fluid attachment to at least one of the first variable volume reservoir, the second variable volume reservoir and the transfer system. A valve may be provided in the conduit that may prevent fluid flow of the ink from the ink storage unit to a printer when ink is being transferred from one variable volume reservoir to another, but which may allow ink to flow from the ink storage unit to the printer when no ink is being transferred from one variable volume reservoir to another.

Ink

The ink may comprise a liquid vehicle having particulates suspended therein. The ink may be an ink-jet ink.

The particulates may comprise a colorant selected from a white colorant, a magenta colorant, a cyan colorant, a yellow colorant, and a black colorant. The particulates may comprise an inorganic particulate. The particulates may comprise a metal oxide. The particulates may comprise a material selected from titanium dioxide, calcium carbonate, aluminum silicate, aluminum oxide, zinc oxide, salts, esters of titanic acid, a mica pigment, which may be coated with titanium dioxide. The colorant may be present in the ink in an amount of 2 wt % to 75 wt %, in some examples at least 10 wt %, in some examples at least 15 wt %, in some examples at least 20 wt % of the ink, in some examples at least 25 wt % of the ink, in some examples at least 30 wt % of the ink. The ink may be a white ink.

The ink may further comprise a latex, which may be in the form of particles. The latex may be in separate particles from the colourant or may form part of the same particles as the colorant. The latex may be selected from polyurethane-based latex, a styrene-based latex and a methacrylic acid-based latex. The latex may be present in the ink in an amount of from about 2 wt % with respect to the colorant wt % present to about 50 wt % with respect to the colorant wt %.

The liquid vehicle may comprise water, and, in some examples, a co-solvent. The co-solvent may be selected from aliphatic alcohols, aromatic alcohols, diols, glycol ethers, polyglycol ethers, caprolactams, formannides, acetamides, and long chain alcohols. The co-solvent may be selected from primary aliphatic alcohols, secondary aliphatic alcohols, 1,2-alcohols, 1,3-alcohols, 1,5-alcohols, ethylene glycol alkyl ethers, propylene glycol alkyl ethers, higher homologs (e.g. C6-C12) of polyethylene glycol alkyl ethers, N-alkyl caprolactams, unsubstituted caprolactams, both substituted and unsubstituted formamides, both substituted and unsubstituted acetamides. The co-solvent may be selected from 2-pyrrolidinone, derivatized 2-pyrrolidinone including 1-(2-hydroxyethyl)-2-pyrrolidinone, 2-methyl-1, 3-propanediol, tetraethylene glycol, and ethyl hydroxypropanediol (EHPD).

The ink may comprise a surfactant. The surfactant may be selected from alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like. Specific examples of surfactants that may be used include, but are not limited to, SOLSPERSE, TERGITOL, DOWFAX. The amount of surfactant added to the formulation, if included, may range from 0.01% to 10.0% by weight.

The ink may include an additive that inhibits the growth of harmful microorganisms, which may be selected from biocides, fungicides, and other anti-microbial agents, which are routinely used in ink formulations. Examples of suitable microbial agents include, but are not limited to, NUOSEPT, UCARCIDE, VAN-CIDE, PROXEL, and combinations thereof.

The ink may include a sequestering agent, such as EDTA. Sequestering agents, such as EDTA (ethylenediaminetetraacetic acid), may be included to eliminate the deleterious effects of metal impurities. Such sequestering agents, if present, typically comprise from 0.01 wt % to 2 wt % of the ink-jet ink compositions. Viscosity modifiers may also be present, as well as other additives. Such additives can be present in the ink-jet ink compositions at from 0 wt % to 20 wt %.

The ink may comprise a buffering agent or pH adjusting agent. The pH adjusting agents may include such pH control solutions as hydroxides of alkali metals and amines, such as lithium hydroxide, sodium hydroxide, potassium hydroxide; citric acid; amines such as triethanolamine, diethanolamine, and dimethyl-ethanolamine; hydrochloric acid; and other basic or acidic components. If used, pH adjusting agents typically comprise less than about 10 wt % of the ink-jet ink composition. Similarly, buffering agents can be used such as, but not limited to, TRIS, MOPS, citric acid, acetic acid, MES, etc. If used, buffering agents typically comprise less than about 3 wt % of the ink-jet ink composition and generally from about 0.01 wt % to 2 wt %, most commonly from 0.2 wt % to 0.5 wt %.

The ink may comprise an anti-kogation agent. Anti-kogation agents that can be used include lithium phosphate, sodium phosphate, phosphate esters of fatty alcohol alkoxylates, and the like, in amounts from about 0.01 wt % to 5 wt %.

FIGS. 5(A) to 5(F) illustrate schematically an example of an ink storage unit according to the present disclosure, and the transfer of ink from one variable volume reservoir to another and back again. The ink storage unit (100) includes a first variable volume reservoir (101), a second variable volume reservoir (102), a transfer system comprising a pump (103), conduits (104) connecting each variable volume reservoir (101, 102) to the pump. A further conduit (105) is provided that can connect to a printer to allow transfer of ink from the ink storage unit to a print head. In FIGS. 5(A) to 5(F), the conduit (105) is fluidly connected to the pump. In some examples, the conduit (105) may be fluidly connected elsewhere, e.g. to on a conduit (104) or to one of the bags. The pump (103) may be a bi-directional pump, i.e., able to pump ink in either direction along the conduit (104). In an alternative embodiment, two single-direction pumps (103) may be provided, as shown schematically in FIG. 5G, each connected to conduits (104) (which are in turn connected to the variable volume reservoirs—not shown in FIG. 5G); in this example, just one pump operates at any one time, so that ink flows from one variable-volume reservoir to another.

In FIGS. 5(A) to 5(F), the first variable volume reservoir (101) and a second variable volume reservoir (102) may be bags having flexible walls, each bag having a port that connects to the conduit (104). FIGS. 5(A) to 5(F) illustrate the transfer of ink from the first variable volume reservoir (101) to the second variable volume reservoir (102), and back again. During this cycle, conduit (105) is closed, e.g., by a suitable valve.

Figures 5A, 5B, 5C, 5D, 5E, 5F:
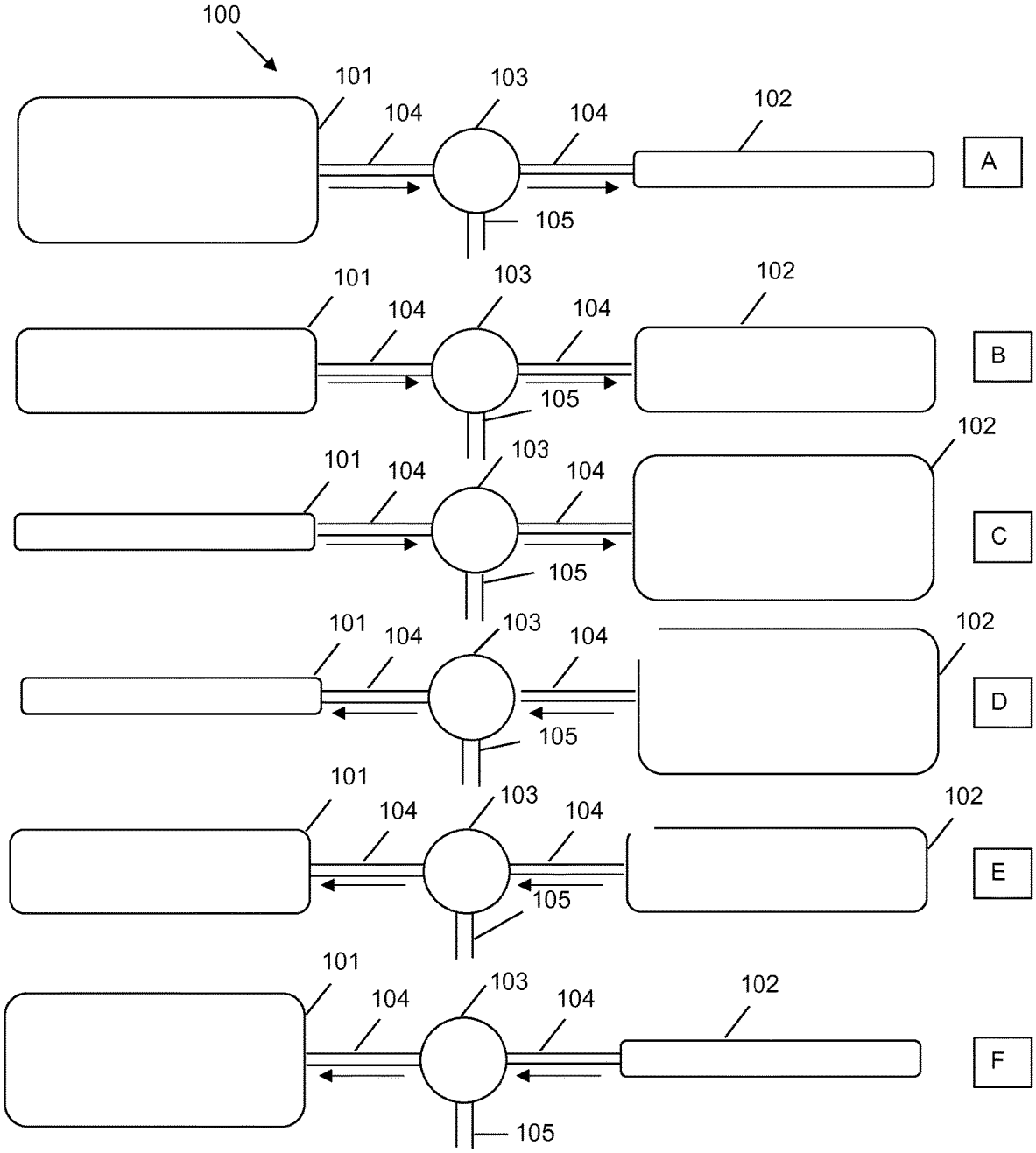
FIGS. 5A to 5F illustrate schematically an example of an ink storage unit according to the present disclosure, and the transfer of ink from one variable volume reservoir to another and back again.
Figure 5G:
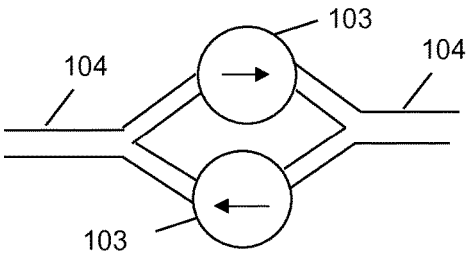
FIG. 5G illustrates two examples of single-direction pumps that may be used in an example of the ink storage unit.

In FIG. 5A, the first variable volume reservoir (101) is full of ink and the second variable volume reservoir (102) is empty. At the start of the cycle, the pump (103) starts pumping ink from the first variable volume reservoir (101) to the second variable volume reservoir (102). As this progresses from FIG. 5A through FIG. 5B to FIG. 5C, the internal volume of the first variable volume reservoir (101) decreases and that of the the second variable volume reservoir (102) increases. In FIG. 5C, substantially all the ink from the first variable volume reservoir (101) has been transferred to the second variable volume reservoir (102). There may be a rest period at this point, i.e., a period in which no ink is transferred. Either immediately after transferring all ink from the first variable volume reservoir (101) to the second variable volume reservoir (102) or after a rest period, the pump then starts pumping the ink from the second variable volume reservoir (102) to the first variable volume reservoir (101), and continues as shown in FIGS. 5D to 5F, until substantially all ink has been transferred from the from the second variable volume reservoir (102) to the first variable volume reservoir (101). The cycle may be repeated. When attached to a printer, the ink storage unit may print during a rest period of the cycle.

Figure 6:
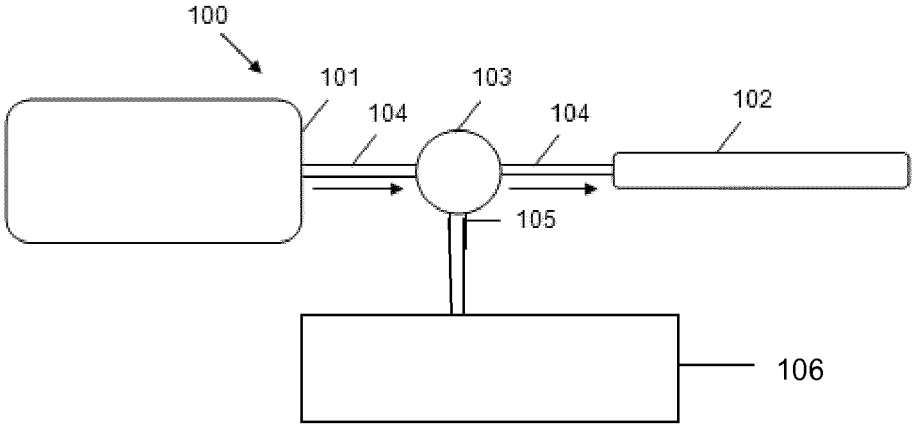
FIG. 6 illustrates schematically an example of a printer as described herein.

A schematic illustration of an example of a printer as disclosed herein is shown in FIG. 6. There, the ink storage unit of FIGS. 5(A) to (F) is fluidly connected to a print head (106). The print head may comprise a print head die having a fluid feed slot along a length to supply the ink to a plurality of drop ejectors, such as orifices and nozzles. The printer or a system of which the printer forms part, may be configured, e.g. programmed, to carry out the method as described herein. The printer may be an ink-jet printer. The printer may be a thermal ink-jet printer. The printer may comprise suitable other components for its operation, including, but not limited to, a media transport assembly, an electronic controller, and a power supply. The media transport assembly is to allow relative movement of the print media and the print head. The controller is to control at least one of the components of the system, such as the ink storage unit, the print head and the media transport assembly. The power supply is to supply sufficient electrical power to the printer to effect its operation.

EXAMPLES

The following illustrate examples of the devices, methods and other aspects described herein. Thus, these Examples should not be considered as limitations of the present disclosure, but are merely in place to teach how to make examples of the present disclosure.

Example 1

Figure 7:
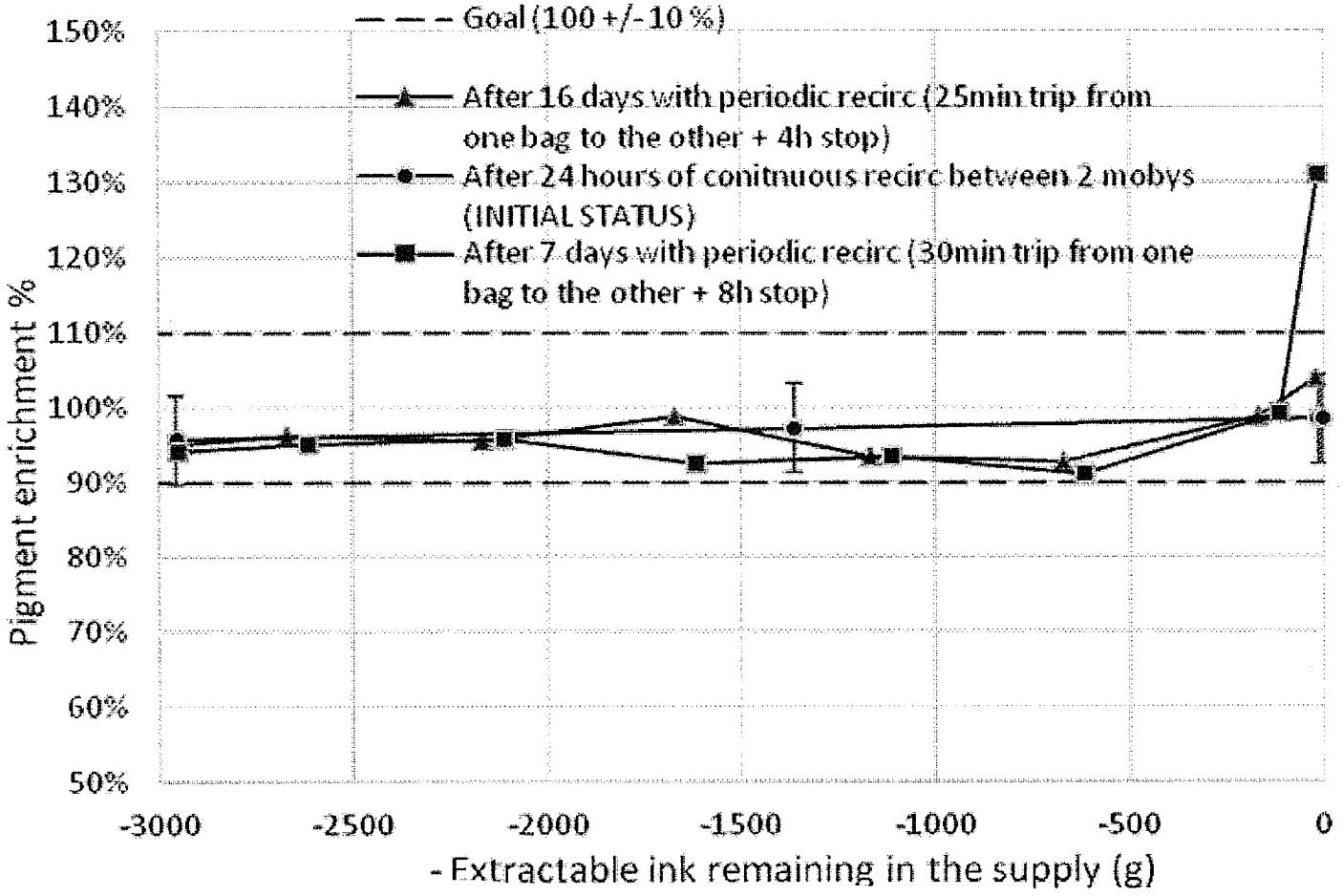
FIG. 7 illustrates the results of a test on an example ink storage unit as described herein in the Examples below.

In one experiment using an ink storage unit similar to the one depicted schematically in FIGS. 5(A) to (G), two separate flexible-walled variable-volume reservoirs (101, 102) in the form of bags having 0.1 mm thick EVOH walls with a maximum volume of 3.5 L configured with one port each were connected together with plastic conduit (104) and 2 pumps (103). The bags may be termed mobys. The transfer unit (103) comprised two single-directional diaphragm pumps (103)—one for pumping ink from the first variable volume to the second variable volume reservoir, the other for the reverse direction, as illustrated schematically in FIG. 5G. All air was extracted from the system and the test was started with a total of 3 kg of ink-jet ink containing titanium dioxide pigment particles that are heavy enough to fall out of suspension over time. The ink in the system was mixed such that all of the pigment particles were well dispersed at the beginning of the test. The ink was transferred from reservoir (101) via conduit (104) and pump (103) at a flow rate of 1.8-2.3 g/s such that ink was extracted until the flow stopped with less than 25 g of stranded ink remaining in the collapsed reservoir 101 (state C). The system was stopped for a dwell time that was varied as part of the experiment and then the ink was transferred back using the same ports and conduit at a flow rate of 1.8-2.3 g/s until flow stopped with less than 25 g of stranded ink remaining in collapsed reservoir 102 (state F). This cycle was continued for multiple days and then ink was sampled from the conduit (104) as it exited the reservoir (101) and analysed to determine the degree of pigment enrichment. An arbitrary range of acceptability, for the purposes of the test, is for ink throughout the supply to have a pigment content between 90% and 110% of well mixed ink. In other tests, the range of acceptability may have different upper and lower limits. This experiment showed that the ink was within this range after 1 day with a dwell time of 0 minutes (continuous recirculation), and also after 16 days with a dwell time of 4 hours. The ink measurements for this experiment are shown in FIG. 7 where the first ink extracted from the reservoir is on the left side of the graph and the weight of ink remaining in the supply decreases with each measurement moving from left to right side of the graph is the last ink to be extracted from the reservoir. This graph also shows that a dwell time of 8*h* is too long for this particular system, resulting in ink with a pigment content that is 31% higher than nominal in the last ink extracted from the supply.

Example 2 (Reference)

Figure 8:
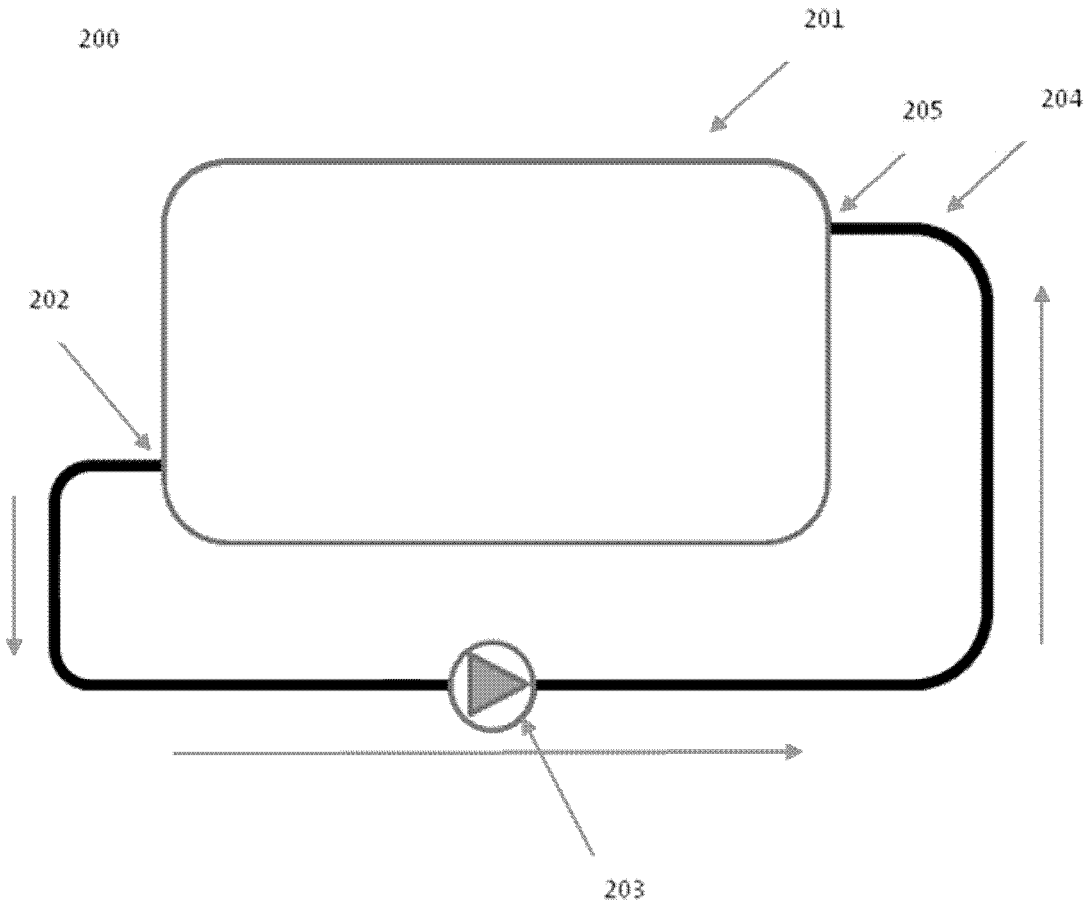
FIG. 8 illustrates schematically an ink storage unit used in a Reference Example described herein.
Figure 9:
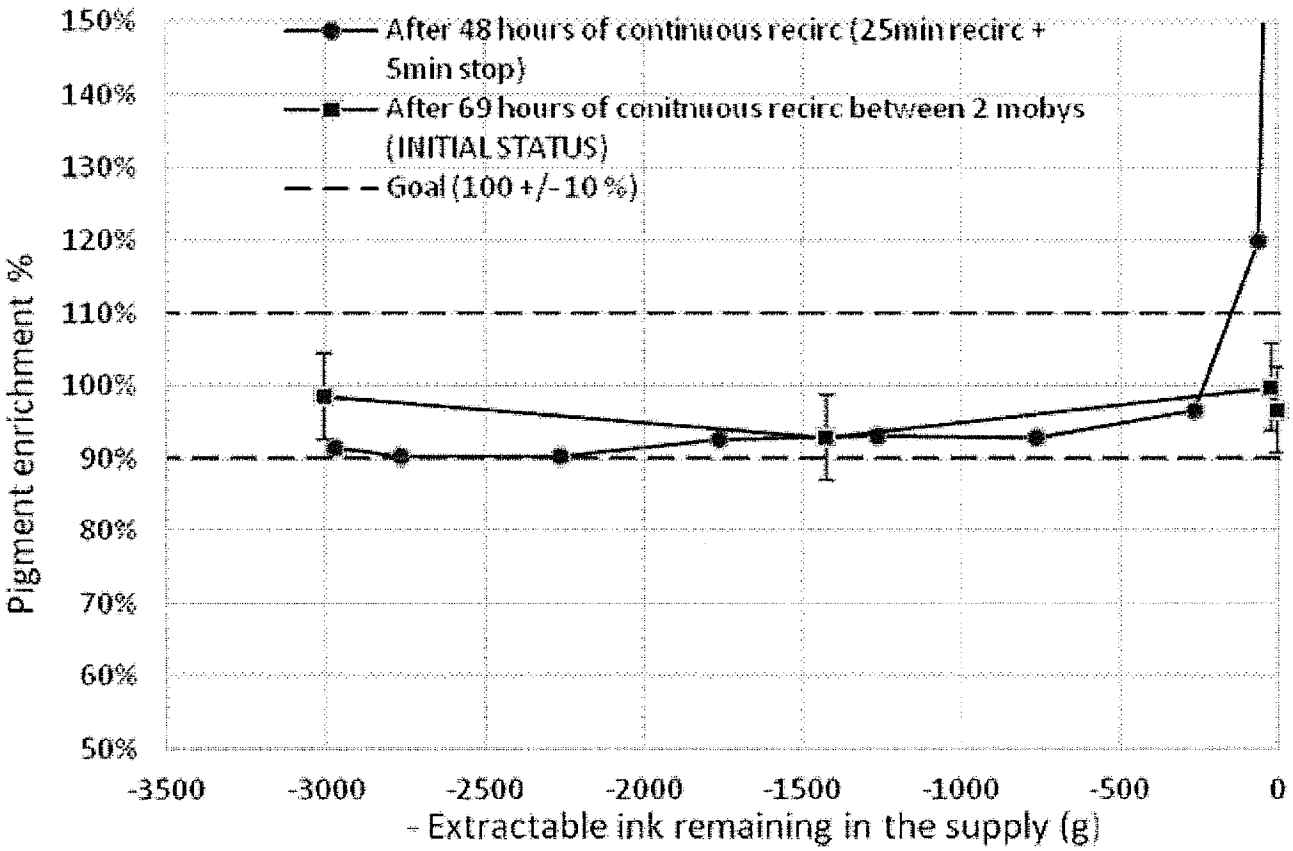
FIG. 9 illustrates the results of a test on the Reference Example ink storage unit of FIG. 8 as described herein in the Examples below.

In another, comparative experiment (the apparatus for which is shown schematically in FIG. 8), a flexible-walled variable-volume reservoir (201) in the form of a bag having 0.1 mm thick EVOH walls with a maximum volume of 3.5 L was configured with a port on each end. The components in FIG. 8 are numbered consistently with those in FIG. 5. The two ports were connected with conduit and a pump of the same type as in the previous experiment where the total conduit length was 0.5-1.0 m. The system was filled with 3 kg of the same white ink that was used in the previously described experiment. The ink in the reservoir (201) was mixed such that all of the pigment particles were well dispersed at the beginning of the test. Ink was transferred out of one port (202) through the conduit (204) using the pump (203) into the other port (205) such that the total volume of ink in the reservoir remained unchanged but ink continuously flowed through the conduit at a rate of 1.8-2.3 g/s. After 48 hours of continuous recirculation in this manner, the quality of ink was evaluated by extracting all of the ink from the supply and periodically measuring the degree of pigment enrichment of the ink as it exited the reservoir. The ink was found to be unacceptably stratified such that the first 2.25 kg of ink extracted from the reservoir was depleted at a level of 90-93% of well mixed ink and the last 100 g of ink extracted from the reservoir was enriched with pigment, containing 193% as much pigment as well mixed ink (see FIG. 9). The expected range of acceptability set for this particular test was for all ink to be between 90 and 110% of nominal pigment content.

The two experimental setups described above used the same pump type and conduits to move ink through the system. The relative effectiveness can be evaluated by the ability of each system to keep the ink mixed at different duty cycles. The two bag system described first was able to keep the ink appropriately mixed with a duty cycle of 9% (25 minutes on+240 minutes off). The single bag system with 2 ports was unable to keep ink appropriately mixed with, even with a duty cycle of 83% (25 minutes on+5 minutes off).

Other tests involving stirring ink in an ink storage unit were found to be inefficient, and, in some circumstances ineffective. They do not address, for example, the settlement of ink in tubes connecting the storage unit to other components of a printer. Similarly, simple vibration of an ink storage unit was not very effective at keeping ink within it dispersed.

Examples of the ink storage unit described herein having two variable volume reservoirs have been found to be able to keep ink in suspension, with very reasonable power requirements. However, the system has reduced complexity compared to some systems. It is believed that examples of the ink storage unit described herein having two variable volume reservoirs are effective at increasing flow at regions that are not very close to the inlet/outlet of the reservoirs. The use of variable volume reservoirs and an air-sealed system during storage of the inks allows transfer of the ink without air being introduced to any great extent into the system, which is useful for prolonging the life of air-sensitive inks.

While the devices, methods and related aspects have been described with reference to certain examples, those skilled in the art will appreciate that various modifications, changes, omissions, and substitutions can be made without departing from the spirit of the disclosure. It is intended, therefore, that the devices, methods and related aspects be limited by the scope of the following claims. The features of any dependent claim can be combined with the features of any of the other dependent claims, and any independent claim.

The invention claimed is:

1. An ink storage unit comprising:

first and second reservoirs, each having a variable internal volume; and a transfer system to transfer ink between the first and second reservoirs such that as ink is transferred from the first reservoir to the second reservoir, the internal volume of the first reservoir decreases and the internal volume of the second reservoir increases;

wherein either of the first and second reservoirs comprises a bag of flexible material that expands to increase internal volume when the transfer system is transferring ink into the bag and contracts to decrease internal volume when the transfer system is transferring ink out of the bag.

2. An ink storage unit according to claim 1, wherein the transfer system is to transfer ink from the first reservoir to the second reservoir and back again.

3. An ink storage unit according to claim 1, wherein the transfer system comprises a pump to pump ink from the first reservoir to the second reservoir.

4. An ink storage unit according to claim 1, wherein both of the first and the second reservoirs comprises a bag of flexible material that expands to increase internal volume when the transfer system is transferring ink into that bag and contracts to decrease internal volume when the transfer system is transferring ink out of that bag.

5. An ink storage unit according to claim 1, wherein at least one of the first and second reservoirs contains an ink.

6. An ink storage unit according to claim 5, wherein the ink in at least one of the first and second reservoirs is a white ink.

7. An ink storage unit according to claim 6, wherein the white ink comprises a material selected from the group consisting of titanium dioxide, calcium carbonate, aluminum silicate, aluminum oxide, zinc oxide, salts, esters of titanic acid, a mica pigment, which may be coated with titanium dioxide.

8. An ink storage unit according to claim 1, wherein the transfer system comprises a bi-directional pumping system in a fluid connection between the first and second reservoirs, the pumping system and first and second reservoirs arranged such that an internal volume of the first reservoir decreases and an internal volume of the second reservoir increases when ink is transferred from the first reservoir to the second reservoir and vice versa, the pumping system to circulate ink back and forth between the first and second reservoir.

9. An ink storage unit according to claim 1, wherein the walls of the bag comprise a plurality of layers including a polyalkylene layer and a layer of polar barrier material.

10. A method comprising:

transferring an ink comprising a liquid vehicle having particulates suspended therein from a first reservoir having a variable internal volume to a second reservoir having a variable internal volume, wherein the internal volume of the first reservoir decreases and the internal volume of the second reservoir increases as the ink is transferred;

wherein ink is transferred in a plurality of cycles from the first reservoir having a variable internal volume to the second reservoir having a variable internal volume and back again, and each cycle has a transfer time period, during which the ink is transferred and a rest time period, during which no ink is being transferred, wherein transfer of the ink, based on the rest time period and the transfer time period, keeps the particulates suspended in the liquid vehicle to optimize printing with the ink.

11. The method according to claim 10, wherein the transfer of ink from the first reservoir to the second reservoir transfers at least 90% of a volume of the ink in the first reservoir to the second reservoir.

12. The method according to claim 10, wherein the transfer time period is shorter than the rest time period.

13. The method according to claim 10, wherein the method further involves printing the ink.

14. The method according to claim 10, wherein the transfer time period is longer than the rest time period.

15. A printer for printing ink, the printer comprising:

a print head, and an ink storage unit comprising:

first and second reservoirs, each having a variable internal volume, a transfer system to transfer ink between the variable-volume reservoirs such that, as ink is transferred from the first reservoir to the second reservoir, the internal volume of the first reservoir decreases and the internal volume of the second reservoir increases;

wherein the transfer system comprises a bi-directional pumping system disposed along a fluid connection between the first and second reservoirs for selectively circulating the ink from the first reservoir to the second reservoir and then back again through the fluid connection between the first and second reservoirs; and wherein the transfer system comprises a compression unit to compress the first or second reservoir.

16. The printer according to claim 15, wherein the transfer system is to transfer ink from the first reservoir to the second reservoir and back again in a plurality of cycles, each cycle has a transfer time period, during which the ink is transferred and a rest time period, during which no ink is being transferred.

17. The printer according to claim 15, wherein the ink in at least one of the first and second reservoirs is a white ink.

18. The printer of claim 17, wherein the white ink comprises a material selected from the group consisting of titanium dioxide, calcium carbonate, aluminum silicate, aluminum oxide, zinc oxide, salts, esters of titanic acid, a mica pigment, which may be coated with titanium dioxide.

19. The printer according to claim 15, further comprising at least one wall in either of the first and second reservoirs that is moveable to change the internal volume of that reservoir and wherein the at least one wall is a rigid wall.

* * * * *